US008173857B1

(12) United States Patent
Yananton

(10) Patent No.: US 8,173,857 B1
(45) Date of Patent: May 8, 2012

(54) ADHESION OF PARTICLES OF ACTIVE INGREDIENTS TO AN OPEN PORE SUBSTRATE

(76) Inventor: Patrick Yananton, Toms River, NJ (US)

( * ) Notice: Subject to any disclaimer, the term of this patent is extended or adjusted under 35 U.S.C. 154(b) by 1578 days.

(21) Appl. No.: 11/169,738

(22) Filed: Jun. 30, 2005

Related U.S. Application Data

(63) Continuation-in-part of application No. 10/975,388, filed on Oct. 29, 2004, which is a continuation-in-part of application No. 10/876,310, filed on Jun. 24, 2004, now Pat. No. 7,647,890, which is a continuation-in-part of application No. 10/745,147, filed on Dec. 23, 2003, now Pat. No. 7,654,227, which is a continuation-in-part of application No. 10/269,713, filed on Oct. 11, 2002, which is a continuation-in-part of application No. 10/033,862, filed on Dec. 20, 2001, now Pat. No. 7,726,260.

(60) Provisional application No. 60/256,882, filed on Dec. 20, 2000, provisional application No. 60/584,542, filed on Jul. 1, 2004, provisional application No. 60/632,981, filed on Dec. 6, 2004, provisional application No. 60/663,185, filed on Mar. 21, 2005.

(51) Int. Cl.
*A61F 13/15* (2006.01)

(52) U.S. Cl. ..... 604/359; 604/360; 428/87

(58) Field of Classification Search ..... 604/359–360; 428/87
See application file for complete search history.

(56) References Cited

U.S. PATENT DOCUMENTS 3,658,578 A 4/1972 Bennett
3,717,897 A 2/1973 Amos et al.
4,774,907 A 10/1988 Yananton
4,800,677 A 1/1989 Mack
4,861,632 A 8/1989 Caggiano
4,913,954 A 4/1990 Mack
4,963,431 A 10/1990 Goldstein et al.
5,173,346 A 12/1992 Middleton
5,338,340 A 8/1994 Kasmark, Jr. et al.
5,431,643 A 7/1995 Ouellette et al.
5,538,783 A * 7/1996 Hansen et al. ..... 442/417
5,599,334 A * 2/1997 Johnston et al. ..... 604/368
5,819,688 A 10/1998 Walker
5,834,104 A 11/1998 Cordani
5,846,603 A 12/1998 Miller
5,961,763 A 10/1999 Makoui et al.

(Continued)

OTHER PUBLICATIONS

Aimone, James, Challenges and Opportunities for Designing and Manufacturing Molded and Needled Automotive Products, pp. 869-874.

(Continued)

*Primary Examiner* — Lynne Anderson
(74) *Attorney, Agent, or Firm* — John D. Gugliotta, Esq

(57) ABSTRACT

The present invention deals with the ability to transform a variety of inert, synthetic, popular, modern nonwovens and other filamentous materials into reactive products having a wide and diverse varying nature due to the coatings that can be successfully applied. This principle holds true especially for the web forming nonwovens of which the high lofts are an ideal dimensional matrix material, for not only having a good carrying capacity for a wide variety of active ingredients, but can scrub and entrap soils and particles as well, sometimes simultaneously. The active ingredient is held and protected within the open cell of the carrier media by means of an adhesion enhancing agent, such as a tackifier, that is coated on the fibers of the nonwoven carrier.

17 Claims, 3 Drawing Sheets

U.S. PATENT DOCUMENTS

| | | | |
|---|---|---|---|
| 6,129,978 | A | 10/2000 | Caldwell |
| 6,219,876 | B1 | 4/2001 | Blum |
| 6,458,442 | B1 | 10/2002 | McKay |
| 6,569,274 | B1 | 5/2003 | Makoui et al. |
| 6,569,494 | B1 | 5/2003 | Chambers et al. |
| 6,746,974 | B1 | 6/2004 | Reiterer et al. |

OTHER PUBLICATIONS

Allen, Jr., H. Charles, The Cotton Fiber Process and Fiber Characteristics, pp. 7-34.
Akers, Paul, Differentiating Superabsorbent Fibers, pp. 119-126.
Angelini, Peter J., Fiber to Web Process—Wet Lay, pp. 567-579.
Gilmore, Thomas F., Protecting Nonwoven Creativity: The Importance of Patents, pp. 890-897, College of Textiles, North Carolina State University.
Arulf, Sandra S., The Polyester Fiber Process and Fiber Characteristics, pp. 59-69.
Bakra, S.K. et al., Neither Woven Nor Knit: A New System for Classifying Textiles, pp. 515-523, North Carolina State University.
Behery, Hassan M. et al., Effect of Production Variables on Properties of Ultrasonically Bonded Nonwovens, pp. 657-674.
Blam, A.F. et al., A New Class of Fire Retarding Latexes for Nonwovens, pp. 305-320.
Bodaghi, Ph.D., Hassan, Melt Blown Microfiber Characterization, pp. 441-477.
Bouchillon, Randall E., Bicomponent Fibers Worldwide, pp. 149-159.
Brandon, R.E. et al., Utilization of Glass Fibers in Nonwoven Fabrics, pp. 179-190.
Britton Ph.D., Peter N., Spunlace Processes Worldwide, pp. 613-627.
Calliari, Mark J., Basics of Nonwovens: Converting Processes, pp. 855-867, Green Bay, Wisconsin.
Chou, Lee-Pei H. et al., A Novel Method to Determine the Binder Level in Nonwoven Webs, pp. 413-433.
Cluthe, Dr. Charles E. et al., Rheology Modification of Coatings for Converting Nonwoven Fabrics, pp. 335-366.
Cooke, Theodore F., Superabsorbent Fibers, pp. 99-117.
Davies, Barrie L., New Developments in Bicomponent Fibers, pp. 127-148.
Ettekoven, H. Van et al., Double-Sided Printing, Finishing and Coating with the Screen-to-Screen Technology, pp. 735-744.
Foster, John H., Needlepunching Past, Present, and Future, pp. 681-702.
Gill, R.A. et al., Design of Acrylic Resin Binders for Medical Nonwoven Applications, pp. 367-375.
Goldstein Ph.D., Joel E. et al., Nonwoven Applications for Polyvinyl Alchohol, pp. 271-283.
Goodchild, William C., Compressive Treatment Technology, Pgs. 757-762.
Hansen, William L., Converting and Product Development Considerations for Pressure Sensitive Adhesive Coated Products, pp. 879-888.
Hardy, Craig, The Rayon Fibre Process and Fibre Characteristics, pp. 35-57.
Hotstetter, B.J. et al., A Monte Carlo Simulation to Predict Tensile Properties of Nonwoven Fabrics, pp. 397-412.
Humphrey, Keith et al., The Application of Image Analysis Within the Nonwovens Industry, pp. 801-824.
Jubilee, Benjamin, Acrylics and Acrylic Copolymer Materials, pp. 197-203.
Kaija, Arnold, Electrostatic and Mechanical Fiber Coating, p. 745-750.
Kelly, David G., The Balance of Strength and Softness in Saturation-Bonded Polyester Nonwovens Used for Interlinings, pp. 839-851.
Kinn, Larry L. et al., Fiber Length-Fiber Surface Area Relationships in Wet-Laid Polyester Nonwovens, pp. 763-775.
Ko, Frank K. et al., Computer Aided Design of Nonwoven Fabrics, pp. 377-396.
Ko, Frank K. et al., Structure and Properties of Carded Glass Composites, pp. 825-838.
Koltisko Ph.D, Bernard M., Vinyl Copolymer Materials, pp. 221-248.
Lochmaier, Wayne, Fiber Classifications and Definitions, pp. 1-5.
Mathews, Grace, Mechanical Finishing, pp. 751-755.
McIntosh, Bruce, Developments in Peek Fibers Opportunities in High Tech Applications, pp. 89-98.
McMeekin, Linda J. et al., Visualizing Structure in Nonwovens, pp. 785-800.
Mercer, Scott A., Innovative Adhesive Application Systems: From Simplicity to Complexity, pp. 655-656, Hendersonville, TN.
Mlynar, Michele F. et al., Processing Aids for Resin Bonded Nonwoven Webs, pp. 249-257.
Johnson, Richard H., Chemical Non-Woven Web Bonding, pp. 629-632.
Johnston, Milo, Resin to Web Process—Meltblowns, pp. 585-604.
Morgan, David J., Bicomponent Fibers, pp. 71-80.
Nelson, David L., Dry Lay Web Forming, pp. 549-566.
Narayan, Ramani, Rationale and Design of Environmentally Degradable Nonwovens, pp. 435-439, Michigan State University.
Pangrazi, Ronald, Low Formaldehyde Nonwoven Binders, pp. 263-270.
Parker, Roy B., Structural Properties of Needlefelts, pp. 605-612.
Powers, Mark, Fiber Spin Finish Technology, pp. 191-196.
Reed, John F., Direct Process Nonwovens: Forming Webs During Fiber Spinning, pp. 81-88.
Riedel, John E., Product Enhancers, pp. 259-262.
Riedel, John E., Nonwoven Web Forming—Fiber Overview, pp. 539-548.
Riedel, John E., Basics of Nonwovens Converting Processes, pp. 853-854.
Rogers, Randall J., Methods, Materials and Products of Thermal Bonding, pp. 633-654.
Ryle, Thomas R., Extrusion Coating and Lamination of Nonwovens, pp. 717-727.
Sabia, A.J. et al., the Effect of Various Silicone Finishes on the Tactile and Physical Properties of Nonwoven Substrates, pp. 321-333.
Scardino, Frank, Evaluation of Nonwoven Fabrics with the KES Testing Equipment, pp. 777-784, Philadelphia College of Textiles and Science.
Shortmann, Walter E., Chemical Treatments for Comfortable Barrier Fabrics, pp. 703-716.
Smorada, Dr. Ronald L., Resin to Web Process-Spunbond, pp. 581-584.
Stark, David E. et al., Foaming Equipment for Nonwovens, pp. 675-680.
Straeffer, Gregory et al, Mechanical and Structural Properties of Melt-Blown Fibers, pp. 479-513.
Stull, Jeffrey O., Converting Processes for Protective Apparel/Devices, pp. 875-877, Austin, TX.
Thompson, Del R. et al., New Fluorochemicals for Protective Clothing, pp. 285-304.
Wilkes, Dr. A.G., A New Viscose Rayon Fibre for Nonwovens, pp. 161-177.
Vandermaas, J.K. et al., Dyeing of Nonwovens, pp. 729-734.
Williams, Martin M. et al., Styrene Butadiene Latex Polymers for Nonwovens Applications, pp. 205-220.
Wadsworth, Larry C. et al., Melt Blown Processing and Characterization of Fluoropolymer Resins, pp. 525-538, The University of Tennessee.

* cited by examiner

FIG. 3
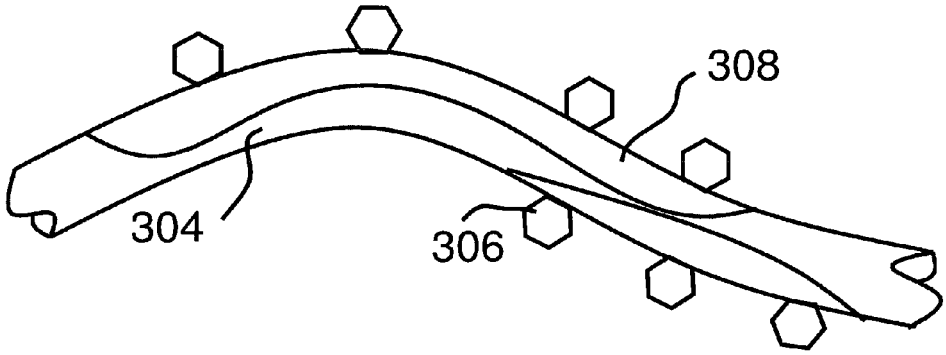
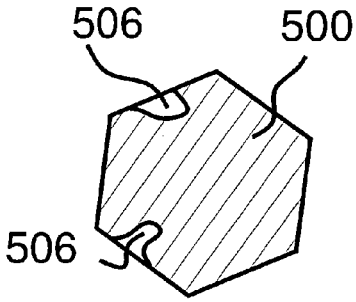
FIG. 5
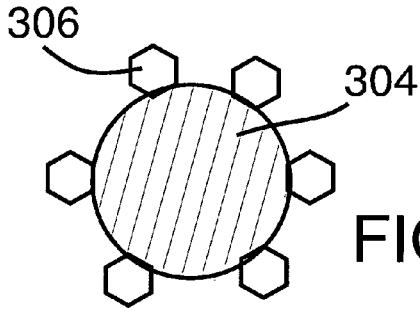
FIG. 4
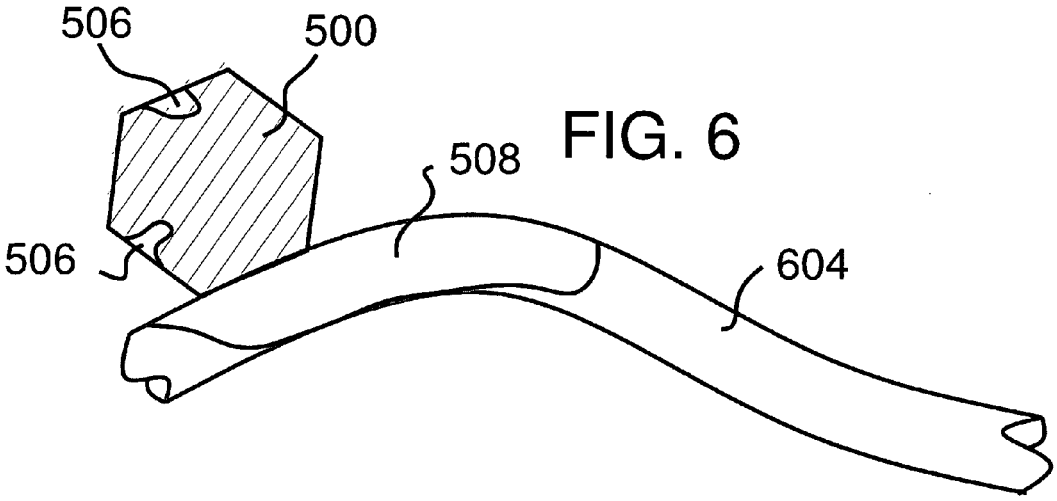
FIG. 6

ADHESION OF PARTICLES OF ACTIVE INGREDIENTS TO AN OPEN PORE SUBSTRATE

CROSS-REFERENCE TO RELATED APPLICATIONS

This application makes reference to the following co-pending U.S. Patent Applications and patents. The first application is provisional 60/256,882 filed Dec. 20, 2000 entitled "Absorbent Pad for Retaining Liquids and Eliminating Odors" which was converted to co-pending applications U.S. application Ser. No. 10/033,862, entitled "Absorbent Pad for Entrapping Small and Coarse Particles, Retaining Liquids and Eliminating Odors," filed Dec. 20, 2001 and U.S. application Ser. No. 10/033,862 filed Dec. 20, 2001 entitled "Absorbent Pad for Entrapping Small and Coarse Particles, Retaining Liquids and Eliminating Odors," The second application U.S. application Ser. No. 10/269,713, entitled "Absorbent Pad for Entrapping Fine and Coarse Particles, Retaining Liquids and Eliminating Odors," filed Oct. 11, 2002 is a continuation-in-part of U.S. Ser. No. 10/033,862 filed Dec., 20, 2001. The third is U.S. application Ser. No. 10/745,147 entitled "Absorbent Pad for Entrapping Small and Coarse Particles, Retaining Liquids and Eliminating Odors," filed Dec. 23, 2003. The fourth application is U.S. patent application Ser. No. 10/876,310, entitled 'Disposable Nonwoven Pad and Method for Entrapping Pet Hair and Dander" filed Jun. 24, 2004 which is a continuation-in-part of U.S. application Ser. No. 10/745,147. U.S. Provisional App. Ser. No. 60/584, 542, filed Jul. 1, 2004 entitled "Adhesion of Particles of Active Ingredients to a Nonwoven Substrate", U.S. application Ser. No. 10/975,388, filed Oct. 29, 2004, entitled Multi Functional Nonwoven Cleaning Pads, U.S. Provisional Application 60/632,981 filed Dec. 6, 2004, and U.S. Provisional Application Ser. No. 60/663,185 filed Mar. 21, 2005. The entire disclosure and contents of the above applications are hereby incorporated by reference.

GOVERNMENT INTEREST STATEMENT

NONE

BACKGROUND

1. Field of the Invention

The present invention relates generally to the novel adhesion of active ingredients to web forming structures, especially structures of nonwoven substrates having an open inner or middle substrate, in addition to a top and bottom, via the use of a compatible chemically inert cling or tack agent or combination of cling agents previously applied to and adhering to fibers and crossover junctions.

2. Related Art

Disposable cleaning devices, ranging from mops to treated wipes, have increased in popularity over the last few years. Products are often sold as clean or sterile items with no dry active ingredient particles embedded within them. Some of the spunlaced, airlaid, and others are sold as dry wipes intended for dust, lint removal while other wet wipes are saturated with various liquids. As these pads and or substrates are used; they become soiled, abraded, torn, clog up, the liquid becomes depleted and are disposed of.

Commercially available wet treated wipes are made from non-woven fibers that can have liquids adsorbed or absorbed within. An example of this would be wet wipes which are flat spun-laced, or airlaid non-wovens saturated with liquids. This method, however, does not, work with many non-absorbent, loftier web forming structures, especially high loft non-wovens, wadding, or similar constructions made of fiberglass, nylon, polyester, polyethylene, fiber composites, or plastic for example.

Although the present prior art cleaning pads and wipes on the market eliminate the use of heavy containers or bottles of liquid powders, or oils, it is difficult to obtain any multifunctionality. For example, prior art wipes cannot adequately pick up larger soils such as grit and sand, yet still contain and deliver a good strong scrubbing ability, containing a scouring, disinfectant agent, detergent, antimicrobials, scent, or combinations of multiple complex ingredients. Multifunctional ingredients, normally incompatible in one solution, are unable to be contained within one wipe, or a limited, as presently marketed in the wet and dry wipes of today.

SUMMARY

It has now been found that inert fibers, web forming nonwoven substrate fibers or pad or particularly those having low to high loft characteristics, can be provided with unique properties, by uniformly distributing active ingredient directly or indirectly throughout and across the substrate fibers, matrix, or pad pretreated with a preferred chemically inert cling, tack, or adhering substance or substances or varying combinations of substances.

A broad aspect of the invention is the incorporation of particles in a web material. The term "high loft" has a standard definition in the art, to indicate large pore web material. An aspect of the present invention is more concerned with the relative size of the pores of the web and the particles that are contained within the pores, then the absolute size or either the particles or the pores. A functional aspect of the invention relates to the incorporation of particles into a web. Where the ratio of the pore size to the particles size, it may be easy to incorporate particles into the web structure. Where the relative dimensions are such that migration of particle into the web meets little resistance, then migration of particles out of the web also meets little resistance. This has been a longstanding problem in the industry.

A broad aspect of the invention relates to a mechanism for incorporating particles into the pore structure of an open pore structure, such that the particles are not free to migrate out of the web structure. In a preferred embodiment of the invention, the porous material is web structure, and in other embodiment the porous material is any open pore structure, such as an open cell foamed plastic.

Where the pore size is so large relative to the size of the particles, that particles can freely migrate from the web structure, the particles are held within the pores through the use of a cling or tack agent.

If the particle is not an active material, then the incorporation of particles into pores does not appear to have any functional value. However, where the particles are an active ingredient, then, for example, air flowing through the web can interact with particles, for such purposes as disinfecting, deodorizing, or the like. This concept applies to any fluid that can flow through the web. In an embodiment of the invention, the active particle is soluble in a fluid that flows through the web. For example, a water soluble disinfectant can be released from within the pores of the web, by exposing the web to water that migrates into the web, dissolves particles and carries the particle out of the web.

BRIEF DESCRIPTION OF THE DRAWINGS

The invention will be described in conjunction with the accompanying drawings, in which:

FIG. 3 is a schematic illustration of a fiber coated with a cling agent and having active ingredients bonded to the fiber through use of the cling agent in accordance with an embodiment of the present invention;

FIG. 4 is a cross-sectional view of a fiber coated with cling agent substance and having active ingredients bonded to the adhesive in accordance with an embodiment of the present invention;

FIG. 5 is a cross-sectional view of a secondary carrier that has sorbed active ingredients in accordance with an embodiment of the present invention;

FIG. 6 is a schematic illustration of a fiber coated with a cling agent and having the secondary carrier of FIG. 5 bonded to the cling agent in accordance with an embodiment of the present invention;

DETAILED DESCRIPTION

Figure 1:
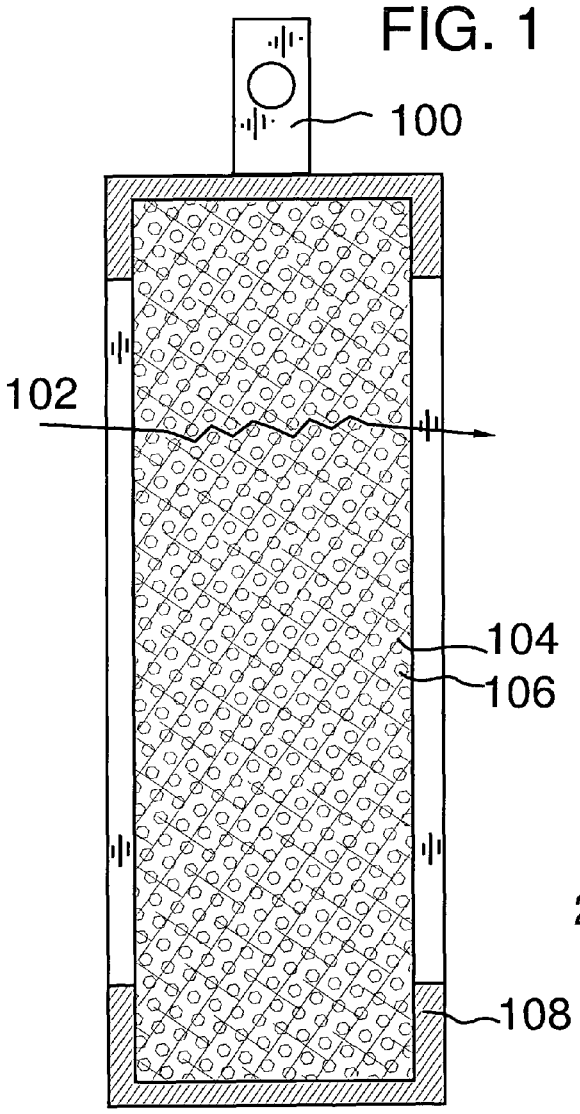
FIG. 1 is a cross-section view of a hanging package in accordance with an embodiment of the present invention.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "adsorb" or "adsorbed" refers any method of accumulation of a substance on a surface, including but not limited to soaking up a liquid or the formation of a layer of atoms or molecules of a substance, on the surface of a solid or liquid.

For the purposes of the present invention, the terms "active ingredient" refers to a chemical, element, compound, mixture, or complex polymer, organic or inorganic solid, gas or liquid, which when used in a particulate form can perform a task such as fragrance release, superabsorption, disinfection, deodorization, sterilization, sanitization, scouring, cleaning, polishing, electrical attraction of other particles, healing, moisturizing, biological reactions, diagnostic reactions, immunological reactions, combustion, insect control, and the like, by virtue of its chemical reactivity. Microencapsulated particles, liquids and gases are included in the term "active ingredients".

For the purposes of the present invention, the term "active particle" refers to an active ingredient in particle form and is inclusive of an active ingredient that is microencapsulated.

For the purposes of the present invention, the term "biological cling agents" refers as those agents necessary to carry biological active ingredients such as antibodies, antigens, collagen, blood, bacteria, viruses, fungi, tissue, cells, and other pharmaceutical, biological, diagnostic, or medical reagents and substances.

For the purpose of the present invention, the term "cellular structure" refers to the spaces, both surface and interior, between the fibers forming the substrate.

For the purposes of the present invention, the terms "open pore" and "open cell" can be used interchangeably with the term to indicate the space within a cellular structure.

For the purpose of the present invention, the term "cling agent" refers to any ingredient or compositions of ingredients that can be used to dip, tumble, spray or otherwise coat individual fibers, crossovers and cellular structures of any fibers, nonwoven, etc. pad. These ingredients cause the fibers to become "sticky" during the non cured or open phase of the ingredient and can either dry to a non-sticky surface upon curing or remain sticky, never completely drying, such as seen in envelopes or notepaper, treated with a cold or hot applied pressure sensitive adhesive. All adhesives can be modified so as to increase the open time, or setting time, strength and tack and other rheological properties. To do so, tackifiers can be added to the adhesive to lengthen the curing time or prevent drying. The critical feature to any of the cling agents or adhering substance is that they remain chemically inert with regard to the applied active ingredient. Synonymous names used are: adhesion enhancing agent, tack agent, cling substance, cling agent, tack substance, tack agent, adhering substance adhering agent, active adhering agent.

For the purpose of the present invention, the term "fiber" refers to a unit of matter, either natural or manufactured, that forms the base element of a fabric and/or other structures. A fiber is characterized by having a length at least 100 times its diameter or width. The term refers to units that can be spun into a yarn or/or used individual to be made into a fabric or other structure by various methods including, but not limited to, weaving, knitting, braiding, felting and twisting. The term "filament" is used herein interchangeably with the term "fiber".

For the purposes of the present invention, the term "highloft" refers to a term for a fiber structure containing more air than fiber. That is, the volume of the open cells represents more than half of the volume of the fiber structure. Specifically, a lofty, low-density non-woven structure that is used for applications such as fiberfill, insulation, health care, and water filtration, personal protection and cleaning materials. These materials are usually produced using a wet or dry air laid forming process among others such as melt blown or needle punched.

For the purposes of the present invention, the term "horizontal rows" refers to rows of any number of active ingredients that extend horizontally starting along the proximal surface of the substrate for a predetermined depth and continuing toward the distal surface of the substrate for a predetermined number of rows. These rows can have any depth applicable to the end use and do not necessarily have to end completely from surface to surface.

For the purposes of the present invention, the term "patchwork" refers to predetermined sections of any number of active ingredients that extend from the proximal surface toward the distal surface of the substrate. These sections can be any size applicable to the end use and can have different active ingredients adjacent to one another.

For the purposes of the present invention, the term "vertical rows" refers to rows of any number of active ingredients that extend from the proximal surface toward the distal surface of the substrate. These rows can have any width applicable to the end use and do not necessarily have to end completely from surface to surface.

For the purposes of the present invention, the term "nonwoven" refers to an assembly of entangled synthetic fibers held together by an interlocking at their interstices, in a random or directional web or mat through mechanical interlocking, chemical, pressure, thermal fusing or bonding with an adhesion agent.

For the purposes of the present invention, the term "preload" refers to the application of active ingredient solid particles to the pre-coated substrates of any loft, and/or its fibers during the manufacturing or converting process, prior to packaging and sale.

For the purposes of the present invention, the term "substrate" refers to a raw material product or device manufactured from a web forming, preferably highloft, matrix or web forming nonwoven. In most applications the substrate will be made from an inert fiber such as synthetic polymeric fibers, such as rayon, nylon, polyester, poly propylene, fiberglass, ceramic, wadding, fiberfill, plastic, fiber blends, or wood pulp, cellulose fibers or other materials that meet the criteria set forth herein. In some applications, a natural fiber may be used. A highloft nonwoven has a measurable, relatively open, middle interior matrix, or cellular structure, as well as a definite top and bottom. The individual fibers of the substrate are capable of being coated with a cling agent then coated with active ingredient. The substrate can be made primarily of nonwoven but also include other filamentous materials such as fiberglass and plastics. The substrate can also be some of the flat, two sided web forming nonwovens structures dry laid, carded, garnetted, wet laid, needle punched, melt blown or compositional not limited to nonwovens.

For the purposes of the present invention, the term "pad" and "entrapment pad" refer to a thin or thick, shaped, cushion like substrate of soft to hard nonwoven materials having a length, width and height. The substrate can be used as a filter media, air freshening device, cleaning, scouring, carpet, wipe, brush, broom, tray, mat, trap, etc., with active ingredients incorporated into or onto the pad. The pad can have multiple uses particularly when active are incorporated into, throughout, or onto the pad. The pad, or substrate, can be made primarily of high or low loft nonwovens, but also includes fiberglass, varying plastic compositions, basalt, ceramic, fiber blends, wadding, cloth fibers, synthetic wood pulp, or paper. A pad can optionally be used in combination with a backing. The backing can be embossed, water proof, porous, etc, For the purposes of the present invention, the term "tackifier" refers to composition that is used to modify the rheological properties of an adhesive to maintain it in the non-cured, or tacky, phase. This modification ability is inclusive of pressure sensitive, and non-pressure sensitive adhesives of varying compositions, as well known in the art. The term "tackifier" is also used to refer to the tackified adhesive while the term "tackifier agent" is used to refer to the adhesive modifying agent itself.

For the purpose of the present invention the term a "secondary carrier" refers to a primary composition that can attach directly to a fiber or substrate, pretreated with a cling agent that also has the ability to accept another active ingredient through adsorption. Examples of active ingredients that can be combined with a secondary carrier would be oils, or petrochemical, solvent, etc. that are difficult to attach directly to strands or fibers of nonwoven.

For the purpose of the present invention the term a "tertiary carrier" refers to a secondary composition that can attach directly to a secondary carrier, pretreated with a cling agent that also has the ability to accept another active ingredient through adsorption.

The entrapment pads consist of inexpensive nonwovens, low to high loft, which can be easily transformed into a variety of diverse products for various categories. The entrapment pad, or substrate, can be provided with multiple unique properties, by uniformly distributing and coating active ingredient(s) directly or indirectly throughout the substrate or pad that can release easily when coming in contact with a target surface. The releasability of the active ingredient can be controlled through the one or more chemically inert cling agents having the desired degree of solubility. The product produced by the disclosed method enables a greater quantity of active ingredient carrying sites to be directly exposed and available to interact with the target. The target can be any surface of a biological or non-biological item or ambient air, water, or gas. It should be noted that all chemicals referenced herein are used in the chemical formulation as defined in the Merck Index, which is incorporated herein by reference. Additional teaching on the adhesive art is taught in WO 2004096494A1 and U.S. Patent Application publication number 20050014434, the teachings of which are incorporated herein by reference as through cited in full. The active ingredient can be adhered to the substrate and/or fibers via dropping, coating, spraying, either directly to the fibers or indirectly to a secondary carrier that attaches to the cling agent coated fibers. The addition of the active ingredient may be done either during the manufacture of the pad or during a post manufacture processing. In any event, the coating and loading of active ingredients is prior to sale of the pad to the consumer. In effect, the coated inert fibers now take on the characteristics of the coating. For example, non absorbent nonwoven, or fiberglass, pads or filaments can become highly super absorbent when particles of superabsorbent polymer are adhered to their surfaces as described.

The particle entrapment pads consist of inexpensive nonwovens, low to high loft, which can easily be made to attract, or entrap, particles routinely found in household soils, or debris. The active ingredient in a particle entrapment pad can be so diversified so as to select or attract a wide range of external particles, such as household grit and dust, to insects and iron shavings, fur, dander, etc. These particulates can be entrapped within the soft or very coarse matrix of these pads.

The static cleaning, anti-scatter, entrapment pads eliminate soils, liquids, and debris from entering into households or migrating from the place of origination to other areas. An example would be a pad that eliminates soils and moisture from entering the home on shoes or a pad that could be used for pets at their feeding places, or under a cats litter box. The high loft fibers of these pads entangle and entrap particulates within the web from the source such as shoes, paws, etc. These pads can be plain, having no active ingredient, treated with a high tack substance alone, that acts as a glue to help hold the entrapped particulates, or can contain an active ingredient such as superabsorbent polymer, fragrance, antibacterial, etc. These pads serve a similar function when placed under other areas easily soiled such as, flower pots, dish racks, soap dishes, garbage pails, and baby highchairs, or in refrigerator compartments.

The active cleaning entrapment pads usually consist of a durable, nonwoven, with or without a backing, containing particulate active ingredient or ingredients. These pads are used to remove a variety of diverse soils by scrubbing, wiping, scouring, mopping, sweeping and other means of movement while also disinfecting, scouring, cleaning, and/or performing other intended chores. These pads or sections of shaped web forming structure can also be treated with plain tacky ingredient for picking up dust, sand and grit, for example. Other uses are for active ingredient pads can be in areas other than cleaning such as, insect control, air deodorization, and the aeration and deodorization or super absorbency of liquids.

The active ingredient is a chemical, element, compound, mixture, or complex polymer, organic or inorganic, biological, solid or liquid, which when used in a particulate form can produce a desired task or multiple tasks such as fragrance release, disinfection, deodorization, sterilization, sanitization, cleaning, polishing, attraction of other particles, biological reactions, and the like. They can be biostatic agents, disinfectants, anti fungal, anti mildew, anti-microbial, dental, diagnostic, medicinal, pharmaceutical, oxidizing, insecticidal, desiccant, dye, odor counteractant, absorbing or adsorbing agent, biocide, fungicide, water absorbing polymer, charged particle, food, cleaner, super absorbent polymer, explosive, microencapsulated, bait, biological cells, diagnostic reagents or other ingredients that can be adhered in some manner to a substrate to fulfill a needed purpose. Antibacterial substances used as disinfectants can usually be divided into several categories. Examples of some of the most popular are the surfactants, halogens, phenolics, quaternary ammonium compounds, and heavy metals, antibiotics, strong acids, bases, and osmotic disruptors. Within each category there is a larger variety of compounds either in a solid or liquid form commercially available which can be combined with a substrate in accordance with the teachings herein.

The active ingredients described within are generally solid particles, although viscous ingredients can be absorbed into a secondary carrier that can be primarily fine, medium, or coarse in size, or a combination thereof, that may be physically confined within the loops and between fibers of a nonwoven as well as attached directly or indirectly to individual fibers. The size of the particles is limited only to that which will adhere to the denier of the fiber forming the substrate. In some instances, the particles dissipate, sublimate, dissolve, attract, and or interact chemically, biologically or physically, when they are released from the substrate and serve their function of combining with their single or multiple target surfaces. Gases can be trapped within a microencapsulated structure so as to function as a usable active agent when released from the encapsulation.

The active ingredient as a solid can be directly or indirectly adhered to the surface of a fiber or multiple fibers, or any specified regions of fibers, or group of fibers as in a pad. The same holds true for a liquid which can be dissolved onto a particulate carrier such as micropourous structures, paper, talc, fibers, etc. Active ingredients include quaternary ammonium compounds, halogens, phenolics, solvents, emulsifying agents, surfactants and drugs or any compound that reacts with a target or surfaces to achieve a purpose. They also include the various chlorine containing compounds usually in the form of hypochlorites, liquid chlorine, chlorine dioxide, organic and inorganic chloramines, 1,3 dichloro5-5 dimethylhydrantoin, 1,2 dichloro 5 ethyl 5 methylhydantoin, and halozone. Dichloro-s-triazinetrione is commonly used in kitchen cleansers as dihydrates. Also included are trichloro-s-triazinetriones used as chlorinators where a stronger release of chlorine is required, as for example, as an algaecide. Many inert carriers such as, paper, talc can be employed to carry the strong oxidizing compounds of halogens, such as iodine, fluorine, bromine and chlorine, oxygen compounds, and peroxides. Active ingredients can be deeply embedded in its carrier substrate, since it can be activated upon being exposed to water or air, or other fluid. Active ingredients can also be activated by virtue of being brought into contact with particles such as dust or dirt, as in the case of charged active ingredients. Active ingredients are used in situations in which a media or substrate to be acted upon is brought into contact with the active ingredient contained within the nonwoven and thus, advantageously, the active ingredients are dispersed, while soils are trapped within the web of the non-woven substrate simultaneously.

The active ingredients may be loaded into the substrate in any configuration deemed applicable to suit the end application. This distribution can be randomly throughout the substrate as a single or mixture of ingredients or specifically placed within the substrate. An example of this would be adding a slightly alkaline active ingredient with chlorine to enhance efficacy. Specific designs for intended purposes include loading the single active ingredient to a substrate in rows, then apply a second, third, etc, active ingredient in another, alternating row. Another coating process could involve loading the nonwoven top with one ingredient separated from another applied to the side.

Rows, either on the surface or in the depth of the substrate, of different active ingredients, or separating the right side from the left, top from bottom, is a technique that is an advantage of using this system. It should be noted that the placement of the active ingredients, either in rows or sections, can be vertical layers, horizontal layers or patchwork and the appropriate application will be evident to those skilled in the art. For example, the method of applying particles or fibers of a positive charge in one row with a close but separate row of negatively charged particles in another, repeated throughout the substrate, when rubbed or wiped sets up an electrostatic charge to entrap dust, metal particles. Various makes of fabrics in close proximity to each other when rubbed or wiped can produce a strong electrostatic charge, such as wool on plastic or inert fibers. Another example would be a single ingredient such as magnetized iron filing particles arranged in lines to attract specific metal filings. In a design for entrapping insects, fleas, ticks, etc. a bait or attractant can be placed in the center of the substrate, with insecticide at the outside perimeter, yielding a silent effective, inexpensive, disposable trap. Alternatively, the insecticide can be eliminated with the bait attracting the insects into the trap where they are caught on cling agent coated fibers.

Scrubbing Bubble® type oxygen producing wipes, mops, etc. can be easily manufactured using this technique by putting oxygen producing compounds on one side of the substrate, and placing a strong powdered detergent, such as for example a baking soda, or sodium chlorite. Oxygen producing compounds include, but are not limited to, sodium perborate, carbamide peroxide, sodium percarbonate, magnesium dioxide, magnesium peroxide, sodium perboratetetrahydrate, borax, calcium peroxide, sodium chlorite, and others well known to the art. When the dry stable substrate containing any separated mixture of these compounds is exposed to water, or other catalyst, a strong bubbly solution of oxygen alone or bleach and oxygen, with suds, scent and bubbles results. By using inert cling agents such as Polyvinylpyrrolidone, ingredients to adjust the pH to any desired range can also be added.

Thus, in all cases, at least a portion of the dimensional substrate is preloaded with active ingredient(s) prior to use, as for example, prior to exposure to air, gas or liquid. The uniformity of distribution and the surface area of the particle's active ingredients are thus maximized. It is noted that some active ingredients diminish over time, with use.

In prior art pads, sponges, etc, the solid particles that polish, scour, abrade, or smooth or the like by physical action on another material, rely on the inert abrasive, particles being at the surface of the carrier that is in contact with the material being treated and must remain there to be effective. In the systems of the present invention active ingredient is distributed throughout the substrate and is intended to release. The substrate described herein in conjunction with any of the embodiments can be used as a wipe, mop, broom, filter, tray, mat, tape, or the like by itself or used in combination with other materials. Alternately the bristles of a broom or standard brush can also be coated via the same technique for example.

The flexible open fiber substrate wipe or pad, etc. can contour to match the shape of a non-planar material, banisters, rails, faucets, etc. With a high loft non-woven, the substrate can contour and the amount of material exposed to the surface being treated, varies with the amount of pressure applied to the pad. Also, particles such as rust, or dried soil and flakes on these objects can be scrapped into and trapped within the substrate of the highloft nonwoven.

As stated heretofore, the active particles, in their original form can be coated on individual fibers and intersections of a substrate or adsorbed onto a secondary carrier, either prior or subsequent to, finalization of the substrate. Coating the substrate fibers with a cling agent and then distributing the active ingredient across the pad and individual fibers greatly enhances the efficacy and economy of the product. It should be noted that for use in most applications the active ingredient will be distributed uniformly, however in some instances localized application, on or within the substrate, may be advantageous. Making the substrate sticky with a cling agent then adding the active ingredients, compliments the mechanical entrapment that normally occurs with thicker denier, or denser fiber count, at the crossover intersections.

The addition of the cling agent can be accomplished either during production by the adhesion or coating process of the airlaid fibers (binder or binder plus tackifier) to finalize the formation of the substrate by adding the tackifier to the adhesive. Alternately the cling agent can be added post production to the substrate. In either case, once the substrate is formed, the cling agent/active ingredient process can be repeated, building up successive layers of the cling agent followed by the active ingredient to create any desired coating thickness. The cling agent can be a cold applied adhesive or a low viscosity hot melt.

Alternatively, during production, a cling agent requiring activation by ultraviolet light, radiation, heat, gas or other chemical or energy source to become sticky can be used to enable the cling agent to be added to the individual fibers prior to formation of the substrate. Once the substrate has been formed, it is treated with the activation catalyst, thereby becoming when desired. The activation catalyst can be any method that will cause the non-tacky cling agent to become tacky.

More complex adhesives such as vinyl ethyl acetates, pressure sensitive latex, the acrylics, various low viscosity hot melt adhesives and glues or the urethanes can be used for more complex bonding situations. As set forth by the examples herein, a variety of high tack, chemically resistant, close to neutral pH adhesives are very adaptable to this process of fixing active ingredients to inert fibers. Examples of solvent based adhesives found acceptable were commercially available over the counter are Elmer's Glue all, 3 M Repositionable 75 spray adhesive, super glue Spray Adhesive, and Duro Spray. Lord Urethane Adhesive, using a variety of dilutions, did not provide optimal performance for the tested active ingredients. Other chemical specialty corporations such as Rohm and Hass, Henkle, etc, were able to provide more specific variety of hot melts, glues and adhesives as well as rheological modifiers and thickeners specific for the intended purpose.

Water soluble cling agents are not only more economical and safer than solvent systems but may, in some applications, increase efficacy. Water based adhesives appear contrary for use in attaching water soluble active ingredients such as chlorine containing products, or Superabsorbent polymers, baking soda, etc. However, the water based adhesives, once applied to the bare fibers of the web, rapidly evaporate the water, leaving only the sticky chemically inert ingredient such as latex rubber remaining behind, which then holds the clump of active ingredient to the inert fiber. Cellulose gums, various carbohydrates, silium, methylcellulose, carageenen and gum Arabic are some natural compounds that also add to the list of functional cling agents.

If a soiled tub or sink is the final target for scouring, cleaning, and disinfecting, the use of the appropriate water soluble tack materials, such as Polyvinylpyrolodone, helps speed up the reconstitution and release of the active ingredients. Examples of water based adhesives are Henkle #40-7027 and #57-7207uv pressure sensitive; Gluefast #779 adhesive, SL poly 3 packaging adhesive, and SL-poly two palletizing adhesive; Rohm & Hass Rhoplex Ec1791 Acrylic Polymer and Robard ps 2000. It has been found that when using rubber latex cling agents that the active ingredient was held firmly on the substrate until released in the aqueous environment. The rubber latex cling agent, however, remained on the fiber after releasing the active ingredient. This enables the release of one or more active ingredients to be somewhat time controlled, that is, time deferred, or prolonged, depending upon the quantity of rubber latex cling agent covering the active ingredient.

The initial cling agent on the substrate maintains the active ingredient within the substrate at its point of placement; preventing shifting of the ingredient up to the time of use. This is extremely advantageous in situations where the substrates are stored vertically, as the active ingredients are prevented from migrating to the bottom of the substrate. The use of the cling agent further enables the active ingredient to be added to the previously manufactured substrates while positioned in a vertical plane, such as a conveyor system. These benefits are obtained whether the cling agent is used to bond the fibers of the nonwoven fabric during the manufacturing process or added after manufacturing.

In applications where the active ingredient is heavily applied to the substrates, or the active ingredient is coarse, excess powders may be prevented from flaking off prior to use by applying an extra spray, or sealing coat, of cling agent after the initial coating process. Polyvinylpyrolidone has been found to be an excellent cling agent and can be used for the sealing coat, as can other water soluble cling agents such carbohydrates; dextrose or sucrose or carboxymethylcellulose; the polyvinyl alcohols, etc. The pads, wipes, or product are individually packaged, for extra protection and contained in an outer box. The latex rubber compounds can be used as well but do not, as stated above, release as totally as the very water-soluble agents.

Using an alternate procedure, in certain applications it is possible to preload the substrate with a powdered ingredient that drops to the bottom of an untreated, lower loft, high denier nonwoven which becomes physically entrapped by the fibers only. A heavy spray overcoating of a water-soluble cling agent such as Polyvinylpyrollidone or the latex rubber compounds will then seal in most of the powder, thereby maintaining the active ingredient in its preloaded position within the substrate.

In some applications it can be desirable to overspray the previously treated, coated fibers with another brief spray of non-reactive adhesive, then recoat with active ingredient without harming the original application of active ingredient. This produces a much thicker coating of the fiber with the active ingredient. When the non-woven is a high loft of an open, coarse structure, it is advantageous to over spray. Spraying may or may not be needed in a more densely packed, high fiber count denier nonwoven. Alternatively, the cling agent can be applied in multiple layers such that each layer forms a base for holding additional active ingredient(s).

Particle Adhesion to a Nonwoven Fabric

Particle adhesion plays a major roll in many industrial fields in that particle adhesion is encouraged (electrostatic copiers, powder coatings, filtration, domestic cleaning products, etc.) or discouraged (microelectronic wafers, soil-proof textiles, technical filters).

Examples of encouraging particle adhesion are widespread and include copiers that use transfer toner particles in an electro-photographic process, powdered paint for solvent free coating, the production of clean wafer surfaces in the microelectronic industry, and the removal of dust particles from an air stream by filtration, or domestic household items by dusting, mopping. Understanding of the interactions that contribute to particle adhesion is the key, whether the end goals is to encourage or prevent adhesion. Particle adhesion is, in general, not something that is well understood. However, the operating theories are familiar to most who work in the area of adhesives or adhesion, and electrostatic cling.

In certain routine conditions once an air borne particle comes to rest on a surface, it often sticks and is hard to remove. The force required to dislodge the particle is not something that is easy to predict. There are three main types of forces that result in particle adhesion: van der Waals forces, electrostatic forces, and capillary attraction. The first two are operative at room temperature and in dry conditions. In wet or oily conditions, capillary action can also occur.

Due to instantaneous fluctuations in the charge within a particle, an instantaneous dipole moment can occur. This induces an attractive force that falls off sharply with increasing separation between the particle and the surface. After the particle and surface have been in contact for some time, the forces may deform the particle to increase the contact area, and this can increase the adhesion dramatically.

Particles larger than 10 nm are likely to carry a small net charge. If the particle is made of a sufficiently insulating material, it can retain its charge and there is an electrostatic force that holds the particle on the surface. The equilibrium charge is roughly proportional to the square root of diameter. Therefore, like the van der Waals forces, the force is directly proportional to the particle diameter. If there is a thin film of liquid adsorbed on the particle or substrate surface, the liquid can flow into the capillary region near the point of contact.

In an attempt to remove particles from surfaces, one generally uses gravitational forces (they fall off when on the underside), centrifugal forces (due to acceleration or vibration of the surface), and flowing forces (like blowing or washing with liquid on the particles There are four distinct systems that hold the preloaded particles to the nonwoven medium described in this invention:

1.) Physical entrapment. Particles of varying size or one size become entangled and trapped in the substrate. In this method, depending on nonwoven density and structure, the smaller particles migrate to the bottom, while the middle holds the medium size particles and the top section contains the larger particles. Many can fall out if turned upside down.

2.) Cling agent enhanced adhesion. Each particle of varying or same size adheres to the sticky cling agent coated fibers in the substrate. The cling agent prevents particles from falling out of the nonwoven or migrating. Particles can be secondary or tertiary carriers for other active ingredients that are embedded, adsorbed, absorbed, etc. onto them. Soils can be trapped this way as well.

3.) A combination of the above plus an addition of a final coat to prevent flaking or dusting of ingredients from pad.

4.) Electrostatic, same as above but fibers are charged by static electricity due to structure and manufacturing process.

The combining of the effects of physical entrapment by fibers with a cling agent or electrostatic enhanced adhesion provides a synergistically enhanced bonding.

Alternate Method for Coating Biologicals onto a Nonwoven Web Structure

In some instances where the biological may need to be preserved for a longer time it is possible to freeze dry a solution of proteins, serums, bacteria cells, complex carbohydrates, cells, antigens, antibodies, compliment, etc. to the nonwovem matrix.

This is accomplished by preparing a solution of a cling agent and a biological active agent in a standard freeze-dryable protective solution, such as skim milk, carboxymethylcellulose, and others. The nonwoven substrate is then immersed into the solution for a few seconds, removed and placed in the freeze dryer. After freezing, all the water is removed via sublimation and a dry, stable, coating is formed on each fiber. The substrate is then capable of being coated further, as discussed herein, via secondary or tertiary coatings or left as is to dissolve on any target surface that is wet.

Use of Cling Agents to Adhere Active Ingredient to Nonwoven Substrate

Many classes and categories of glues, hot and cold adhesives, and tackifiers, exist and are well know to those skilled in this art. It has been found that the water-soluble chemically resistant families of Latex rubber, acrylic, glues and adhesives perform well for general cold application purposes. Solvent based latex rubber and Urethane, etc. perform well also. Many of the commercially available over the counter latex rubber, acid free sprays preparations were screened and tested. 3M, Borden's, and Devcon preparations of chemically resistant latex rubber worked as well as commercially available brands from scientific supply specialty facilities. A high tack urethane adhesive #7650 from Lord Adhesive successfully provided the adhesion of a variety of active ingredients previously listed but not as well as the water soluble pressure, packaging adhesives, supplied by Rohm & Haas, Henkle Adhesives, and Gluefast. Low viscosity hot melt adhesive are also available from Henkle, Reynolds, National Starch, Rohm and Hass, and many others.

Diphasic, Triphasic Cling Agents

As mentioned certain cling agents such as polyvinylpyrolidone, some of the polyvinyl alcohols and others can also be a carrier for dissimilar dissolved ingredients, while attaching another powdered or particulate ingredient. An example of a diphasic cling agent is Iodine dissolved in the cling agent polyvinylpyrrolidone. The diphasic cling agent is then applied to the fiber as taught herein and the active ingredient, such as an antibiotic, is applied.

An example of a triphasic cling agent would be one that contains two or more dissolved ingredients within the cling agent such as a surfactant, a blue dye, and a scent, dissolved in polyvinylpyrrolidone. This mixed cling agent is applied to the fibers and an active ingredient, for example a powdered disinfectant such as sodium dichloro-s-triazinetrione dehydrate, is applied as taught herein. When the nonwoven fibers coated with this material contact a wet surface, the dye is released giving a visual effect to the entire system of disinfectants, scent, and surfactants at work.

As mentioned earlier, a highloft device, mop, or wipe can be coated entirely with one formulation as mentioned above or using two different formulations that complement or react with each other by alternating rows of coatings.

Degradable Biological Cling Agents Requiring a Preservative.

Immunological reactions can occur using antigen coated nonwovens first coated with an inert substance such as albumen. Many of the cling agents needed for biological reactions, such as Albumen, viscous proteins, serum and gelatin for example, have a definite shelf life before they begin to degrade and may require a preservative. Any common food preservative or antibacterial can be added prior to the spraying or dipping of these biological cling agents.

For example, tissue culture can become more enhanced and yield a greater harvest when the cells grow on a matrix of nonwoven previously coated with a biological Cling Agent such as Collagen, or serum proteins.

Tackifier Resins

Tackifier resins can be added to base polymers/elastomers in adhesives to improve the tacky properties of the combination. The increased tacky properties are achieved by better wetting out onto a surface and improved specific adhesion.

In simple terms, one can visualize a tackifier resin as reducing viscosity. More specifically, the resin ultimately determines the viscoelastic behavior of the final adhesive. As an example, a suitable styrenic block copolymer (that does not have tack and cannot wet out), mixed with a suitable concentration of a compatible resin, and amazingly it sticks. Wet or dry tack results are well known by those skilled in the art.

There are many types of resins available from a broad range of suppliers. There are a number of ways that they can be grouped; the most common way is by the feedstock used to produce them.

Rosin resins

Hydrocarbon resins

Terpene resins.

There are also important sub-classes within these three groups.

Rosin Resins

Rosin acids are derived from the root (wood rosin) or sap (gum rosin) or from the Kraft process (tall oil rosin). Rosin acids can be tackifiers themselves but it is more common to use their ester derivatives. The most common rosin resin type used in adhesives is rosin esters. They are ideal to impart excellent, aggressive adhesion to almost all polymer types, including, natural rubber, EVA, SBR, SIS, SBS, and acrylates. The one difference between non-hydrogenated and hydrogenated rosin resin is that simple rosin-esters do not tackify APAO very well, as for example, PERMALYN™ 3100, ABALYN-E™. Rosin contains a significant quantity of unsaturation and therefore it is not very stable to heat and oxidation. To improve the stability rosin can be hydrogenated.

Hydrogenated Rosin Resins

Hydrogenated resins provide for the same excellent, aggressive adhesion in adhesives as does rosin-esters but with improved (lighter) color and stability. They are available in two types:

a) Partially hydrogenated b) Fully hydrogenated.

Increasing the degree of hydrogenation results in a light color and better stability. Such types may even be used in medical psa for adhesion to skin since they have been proven to be hypoallergenic and non-skin sensitizers as for example, FORALYN™ 85-E.

Hydrogenated rosin esters are highly compatible with most polymers but are ideally suited for SIS and SBS where they impart excellent adhesion to an adhesive without a significant reduction in cohesive strength (compared with a non-hydrogenated rosin-ester). They are also ideal tackifier resins for APAO. (As for example, FORALYN™ 90.

Hydrocarbon resins are generally made from petroleum-based feedstocks either aliphatic (C5) or aromatic (C9) or dcpd (dicyclopentadiene) or mixtures thereof.

Hydrocarbon Resins—Aliphatic (C5)

These resins have Gardner colors between 1, 5 to 6 (from light yellow to light brown) and are mostly used to tackify aliphatic polymers, especially natural rubber, EVA, SIS, and APAO. They impart excellent adhesion to these polymers but tend to produce a high adhesive viscosity. The resins have a low but distinctive odor, as for example, PICCOTAC 1095 and PICCOTAC™ 1094-E.

Hydrocarbon Resins—Aliphatic (C5)

They are usually dark in color within typical Gardner values of 6 to 10 (dark yellow to dark brown). They are mostly used in EVA based adhesives or added to water-based flooring adhesives, especially C9 liquid resins. They tend to have a very distinct aromatic odor, as for example, PICCO™ A100.

Pure Monomer Aromatic Resins

When adhesive applications require an aromatic resin but low to no odor, stability, and a light to water-white color then this category is the one of choice. There are aromatic resins based on pure monomer feedstocks. The resin is usually water-white with excellent stability. The lower softening point (up to 100° C.) are mainly used in EVA for bookbinding adhesives but are also used to improve creep resistance in HMA for diaper constructions, as for example KRISTALEX™ 3100, and KRISTALEX™ F100. High softening point pure monomer resin types are most useful as end-block re-enforcers (enhance cohesive strength) in styrenic block copolymers, SIS, SBS, and SEBS, as for example, PLASTOLYN™ 240 and ENDEX™ 155.

Hydrocarbon Resins—Aliphatic/Aromatic (C5/C9) Mixed Feedstock Resins

This type of resin is usually based on a C5 feedstock with additions of aromatic monomers such as styrene, or mixed C9 resin oil. They tend to be darker in color than C5 resins but the use of purer feedstock's results in lighter colors, up to Gardner 1, 5 is achievable. They normally have a distinctive odor. They are excellent cling agents for use in EVA, SBS, and natural rubber polymers. They can also be used in SIS-based HMPSA to provide for low melt viscosities but an optimum balance between cohesion and adhesion. Sometimes the slightly aromatic modified C5 resins are used in APAO to provide limited compatibility resulting in shorter open times. (PICCOTAC™8095) Darker colored, lower cost types are often used in packaging HMA based on EVA. In this case, the resins are mostly C9-based but copolymerized with C4 aliphatic monomers. See for example, PICCO™ HM100.

Hydrogenated Hydrocarbon Resins

When color and stability is an issue a good choice for a tackifier is a hydrogenated hydrocarbon resin. Most hydrocarbon resins contain unsaturated double bonds in their structure, which is associated with instability. Hydrogenation of these sites results in highly improved stability and an improved color. Usually these resins are colorless, known as water-white in the industry. They are very stable to heat, weathering and oxidation and most of the types are hypoallergenic, with no skin-sensitization properties. Thus, they are ideally suited to applications where these criteria are important, such as in medical adhesives, colorless adhesives, and clean running adhesives. The group can be divided into:

A) fully hydrogenated types (aliphatic in nature), and

B) partially hydrogenated types (aliphatic/aromatic in nature).

The fully hydrogenated types are most suitable for SIS, SEBS, EVA and APAO polymer based adhesives. Partially hydrogenated types are suitable for use with SBS, EVA, APAO, and some acrylates, especially based on 2-EHA and BA.

Liquid Resins

Liquid resins can be manufactured from rosin or hydrocarbon feed stocks and finds use as low molecular weight additions to adhesives to plasticize and impart tack. They are often used in HMPSA formulation based on SIS and SBS to improve low temperature properties, soften, and improve adhesion. Aromatic C9 type liquid resins are often added to flooring adhesives to improve legging.

Terpene Resins

Terpene resins are derived from terpene feedstocks either from wood sources or from citrus fruit. These resins are also polymerized by AlCl3. Rosin is one of the oldest raw materials for the adhesives industry, either as such, or converted to rosin ester. Three types of rosin are used for resin manufacture, gum rosin, wood rosin and tall oil rosin, all generated from the pine tree.

Gum rosin was once the only commercial source of rosin and is the oleoresin (pine gum) of the living pine tree. The harvesting of the oleoresin is simple, involving only periodic wounding of the tree and collecting of the exudates into cups.

Wood rosin. After harvesting pine trees, the stump is allowed to remain in the ground for about ten years so that its bark and sapwood may decay and slough off to leave the heartwood rich in resin. Resinous material is extracted from the stump.

Tall oil rosin, as for example PAMITE™ 79 Tall Oil Rosin, is obtained by distillation of crude tall oil (CTO), a by-product of the Kraft sulphate pulping process. CTO contains 70-90% acidic material, which is composed essentially of fatty acid and tall oil rosin. Tall oil rosin (TOR) has a tendency to crystallize and usually contains 200-600 ppm sulfur. Highly distilled TOR can produce esters that are competitive with gum and wood rosin derivatives.

Rosin Chemistry

Rosin resins, unlike hydrocarbon resins, are not polymers. In fact, they are a blend of different molecules.

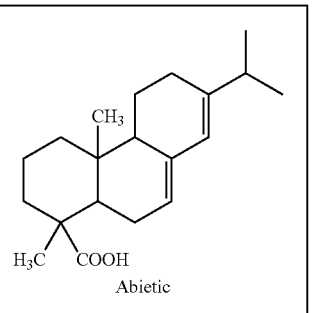

Structures of rosin molecules

Rosin resins have a wide span of compatibility with almost all polymers. They are well known for their peel and tack contribution to the adhesive, but generally decrease cohesive strength.

Rosin molecules have poor stability caused by unsaturation. Stability can be improved by various methods such as disproportionation and hydrogenation.

Carbohydrates, either simple or complex can form a viscous, sticky, coating upon drying with dextrose and sucrose being inexpensive and readily available. More complex polymers can also impart this stickiness.

Examples of other cling agents are polyvinyl pyrolidone, polyvinyl alcohols, viscous fats and oils, carboxymethylcellulose, acronal 700, carageenan, gum arabic and others, however any substance, or combination of substances, that meet the criteria set forth can be used. The substance should remain sticky while adhering to a fibrous surface or substrate, allowing an active ingredient to be applied, without entering into a chemical reaction with the active ingredient or causing its instability. The substance should, upon drying or remaining sticky, allow the active ingredient to adhere to the fibers of the substrate. Combinations can be quite effective as for example combining a 20% solution of Dextrose with a 20% solution of polyvinyl pyrolidone as for example.

Rohm & Haas as well as other chemical and adhesive/glue manufacturers supply cling agents that are tacky and vary widely in the degree of surface tack or open time prior to setting up or curing. This range also includes full line of pressure sensitive latex and acrylic adhesives and glues. The "tackiest" is Robond PS-2000, followed by Rhoplex 1791.

Compositions, such as polyvinylpyrrolidone (PVP), or synonymous combinations such as polyvinyl propylene, or the iodine PVP called povidone can be also be used as cling agents in their own right, or as a carrier for an adhesive or other sticky ingredient, such as carboxymethylcellulose, glucose or sucrose, etc. PVP can also be used as the sealing coat to hold the active ingredients in place until used, as it rapidly dissolves upon contact with a wet surface, releasing the active ingredients. Solutions of PVP in a 10 or 20 or 30% concentration are sticky when applied wet via dip or spray and in this "TACKY" state can hold powdered active ingredients onto the desired substrate. The dried PVP/active ingredient combination coats the fibers quite well and maintains the active ingredients in place. Additional coats of PVP and active ingredient(s) can be applied to build up the active ingredient(s) to the desired thickness with a final application of a sealing coat if desired. The sealing coat can be of any thickness appropriate for the application. The sealing coat can also contain other dissolved ingredients, which may compliment the rehydrated reaction. An example would be to add a final spray of iodine containing polyvinylpyrrolidone, to a substrate containing powdered a disinfectant to obtain a duel reaction. In some instances the duel combination of ingredients is far stronger than the one or the other allowing for the use of lesser quantities. Exact quantities of active ingredient can be calculated per spray, or dip per pad.

Examples of Nonwoven Pads and Devices having Cling Agent Enhanced Active Ingredient Addition Hot melt adhesives are used in the hygiene industry almost exclusively for the manufacture of nonwoven products including baby diapers, adult incontinence products, and feminine care personal hygiene products. These adhesives require raw materials with superior technical performance as well as consistent quality. Since most nonwoven products are high-speed machine manufactured, (up to 1000 feminine care products made per minute) a consistent adhesive is the key to optimized production. Hot melt adhesives supplied by Henkle, National Starch and Chemical, Reynolds and many other suppliers can be used to adhere active ingredient to fibers. A low viscosity, low temp hot melt can be used in the manufacturing process, or after the web structure is manufactured Specifications for High Lofts The following chart characterizes some of the specifications categorizing the high lofts that range from low density to high density based on weight and height.

Starting from a very High loft, heavy density to a low density, the following examples of materials from Ahlstom are as follows

| | Weights oz/sg. ft. | Thickness/ height - inches |
|---|---|---|
| 545 AD | 3.1. | 1.36 |
| 545-67 | 2.4 | 1.36 |
| HDP 1590 BD | 0.90 | 1.625 |
| PB63DA | 0.63 | 0.65 |
| KW 30 | 0.36 | 0.30 |
| HPR 27PR | 0.28 | 0.19 |
| HP 15 DHBA | 0.20 | 0.25 |

Of these web forming structures the air laid, dry laid or wet laid, high loft nonwovens represent a group that have special advantages as a carrier or catching substrate by way of their very open, sturdy, matrix. The high lofts can carry more active ingredient, entrap more particles not only by their top or bottom surface structure but especially by their inner cellular structure. Cling agents can easily coat the interior or these high lofts as compared to other web forming structures such as the carded, needlepunched, garneted, melt blown and others well know to those skilled in the art.

Web forming structures, such as mentioned above, are coated on the top and/or bottom surfaces with the cling agent and then coated with active ingredient. Although the web structures are not applicable for the same uses as the highloft configurations they are valuable where in that they can be used for their own unique applications. Due to the structure inherently formed with a nonwoven, there will be some open cellular structure on the surface, with the depth of the cellular structure determining the loft. Even a needlepunched nonwoven with have a cellular structure sufficient deep and fibrous to allow for cling agents and active ingredients to be applied. For example, a flat-carded crosslapped can have superabsorbent polymer adhering to the bottom side and a plastic sheet added to the base to create a two-layer cat or puppy pad.

Many older substrates, such paper, nonwoven, fiberglass, and plastic screens and filters are used by themselves or as a carrier within a device to contain odor counteractants, water softeners, medicines, disinfectants, sanitizers, etc. An emulsion solution has to be sprayed onto the fibers. The resulting emulsion is then "wicked" into Air or water flow. In some applications, such as air fresheners, the ingredients are dissolved in oil, alcohol, gel, or other base prior to application over the surface of the substrate which then gradually "wicks" the active ingredient into the air, water, or onto another surface. Consumers have become used to placing a box of Arm & Hammer Brand Baking Soda into their refrigerator so as to presumably deodorize any odors that accumulate. Attempts have been made to improve the design of the box so as to yield more surface area of the baking soda. Inherently the mass of powder will not allow air to flow sufficiently through it so as to maximize deodorization. Baking Soda at best is a poor deodorizer.

Using our process, baking soda, odor counteractants, zeolites, powdered charcoal, etc. can be added to a nonwoven web matrix that allows plenty of air flow across millions of sites of active ingredient. Systems based on fragrant gels, and oils can be converted over to dry web refills that emit fragrance into the air or can remove and deodorize odors "out" of the air.

As illustrated in FIG. 1, an air freshening, deodorizing device, the treated substrate 104 can be housed within a container 108 having one or more window regions, such that air 102 can flow through the cellular structure of the substrate 104 and come into contact with active ingredients 106. The device as illustrated can be designed to be hung from a hanger member 100. This embodiment may be easily adapted for use in air freshening devices using baking soda, fragrances, micropourous structures, deodorizers, or odor counteractants. Unlike the prior art, the active ingredient is not "wicked" out, but rather a solid particle of active ingredient is adhered to a solid fiber. The active ingredient can be a talc particle saturated with aromatic fragrance, an odor absorbing compound like zeolites, powdered charcoal, popouri, etc. The outside edges of the substrate 104 can be cardboard, plastic or other medium 108 to hold the item during shipping and/or use and serve as vertically mounted device. In the embodiment shown in FIG. 1, a cardboard or plastic frame hanging device 100 may be used in a in a refrigerator, freezer, room, airvent, air conditioning, garbage pail, or car, etc. and to catch any particles of active ingredient should they somehow be dislodged. The frame structure can be of the type commonly used for HVAC filters. This device is different than paper soaked deodorizers as this substrate 104 allows air to flow through it past the active ingredients 106. A hook or double stick adhesive can be used for attachment or hanging the device.

Thus the device can provide not merely fragrances, but can hold active ingredients such as a baking soda, charcoal, silica gel, or a mixture of all, including patented, commercially available, odor counteractants in combination with one or all three ingredients. In applications where odor absorbing materials such as baking soda, activated charcoal, silica, etc. are used, it is important to have the maximum amount of the particle exposed to adsorb and imbibe the offensive odors. Since many counteractants have time release elements, this embodiment is ideal for refills for small commercially available plug-in fan devices, or for refrigerators, air vents, air conditioners, fans of all types, heaters or any place in the home, car, workplace, etc. where air is circulated. Using the disclosed safe system negates the use of irritating solvents associated with oils and alcohols that are puffed into the air, via fans, wicks, or gels, presently used and commercially available such as Airwick, Glade, and a large host of others. These systems take particulates and odors out of the air whereas the present commercially available systems have to put alcoholic solutions of oils into the air.

In order to retain an active ingredient within the carrier, some prior art methods sandwich the ingredients in between two or more layers of nonwoven materials. In these applications, such as tire wipes, toilet bowl cleaners, dishwasher detergent, laundry cleaner pads, scouring pads or cat or dog absorbent waste pads, the active ingredient may be applied as a granular material such actual powder, or pellets directly to the fibers treated with an adhering or cling agent. Older methods sandwiched active ingredient in between layers, of absorbent pads of wood pulp, sponges, blotters, pads, or other materials that physically held the powder mix or paste mix. With other existing prior art methods, when the ingredient is required to be applied to a nonwoven, it is necessary to prepare an emulsion to spray the exposed fibers of the carrier. This method frequently results in small quantity of diluted active ingredient actually coating the fibers. The emulsion or mixture needs to be stable which is difficult to accomplish with strong oxidizers, acids or alkalis such as bleach, ammonium compounds, or peroxides for example. Also these coatings are not stable, degrade, and are easily dislodged from the substrate when used in an active mixing environment or too great a concentration. Therefore the older ways of applying coatings to various inert filaments and fibers as found in a variety of materials has substantial limitations.

Using the disclosed method, the concentration of dry ingredient can be calculated precisely so that when the substrate, whether a pad, wipe or a mop, etc., contacts a predetermined approximated volume of liquid an exact solution is formed on the site to be acted upon. This saves the user from handling bulky containers of fluid, pouring, closing, storing, etc. For example, a pad, in accordance with the teachings herein, containing one gram of di-chloro triazinetrione powder can be used to clean a prewet tub surface of approximately 200 mls., giving a rough 0.5% final concentration of released disinfectant. This amount of disinfectant is more than enough to be considered bactericidal and fulfill EPA requirements, however not enough to cause irritation. The disclosed method enables active ingredients that are potential irritants, such as chlorine, to be easily used without user safety issues. Other uses can include diagnostic reagents for various laboratory auto analyzers.

Figure 2:
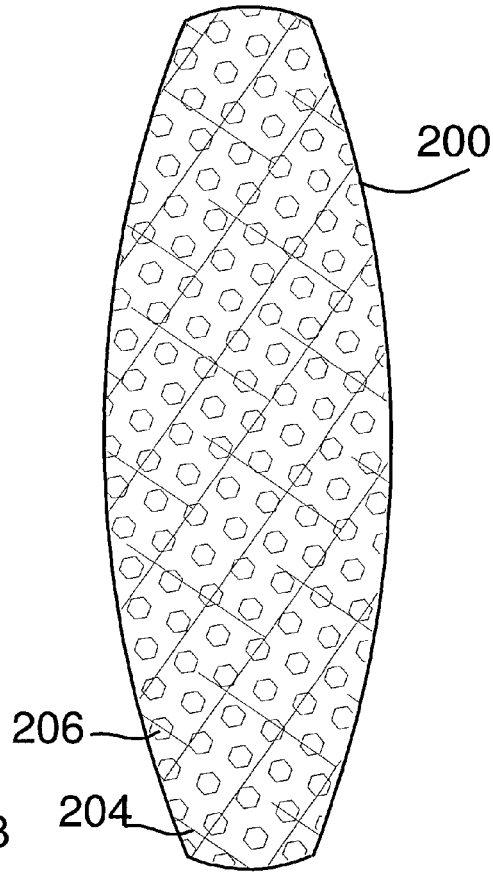
FIG. 2 is a cross-sectional view of a non-woven pad in accordance with an embodiment of the present invention.

By way of example, a 5×5 inch of PB63 DA dry laid High Loft Non-woven swatch, such as pad 200 of FIG. 2, supplied by Ahlstrom Filtration, is first spray treated with an inert cling agent, such as a non-acidic latex rubber adhesive, acrylic or polyvinylpyrolidone. A powdered active ingredient 206, such as powdered baking soda, and/or pelletized baking soda #2, and #4, is added via spray, drop, mixing, etc., to the substrate 204. The resultant substrate 204 is now charged with a variety of particles that penetrate a large percentage of the cellular structure from top to bottom, creating a large surface area of active ingredients with room for air or water flow. The concentration of particles can be designed to yield maximum performance using a minimal quantity of active ingredient, to achieve a desired effect such as air freshening, deodorization or sanitization, etc. After drying the coated substrate 204 may be once again lightly sprayed with a cling agent if firmer adhesion is required. Successive layering active ingredients 206 or a sealing coat can be performed if desired. Using a thickener such as Rohm and Hass Aerosol #60 or #95 will thicken the acrylic cling agent causing a thicker coat as well. Other rheology modifiers can accomplish this as well. Any other solid powdered, granular, or pelletized deodorizer, disinfectant, super absorbent, micro encapsulation, etc. can be used.

In the present invention, using the direct coating method, the fibers 304, or substrate, of FIGS. 3 and 4 is first treated with a cling agent 308. Warm air flow can be used to speed up the tack formation process. The active ingredient particles 306 of any size or type are then dropped, pressure sprayed, mixed, tumbled, or otherwise applied so as to thoroughly coat the sticky fibers 304 of the substrate. In situations where multiple active ingredients that are incompatible in the non-desiccated form, or multiple ingredients are required, the ingredients can either be mixed together and applied to the substrate or applied separately. When applied separately, the first layer of active ingredients would be applied over the cling agent, a second layer of cling agent applied and the second active ingredient applied. The numbers of layers of one or more ingredients will be dependent upon the application and will be known to those in the art. After a final layer of active ingredients, a sealing coat can be used once all of the layers have been applied to secure any loose particles to the structure.

Figure 8:
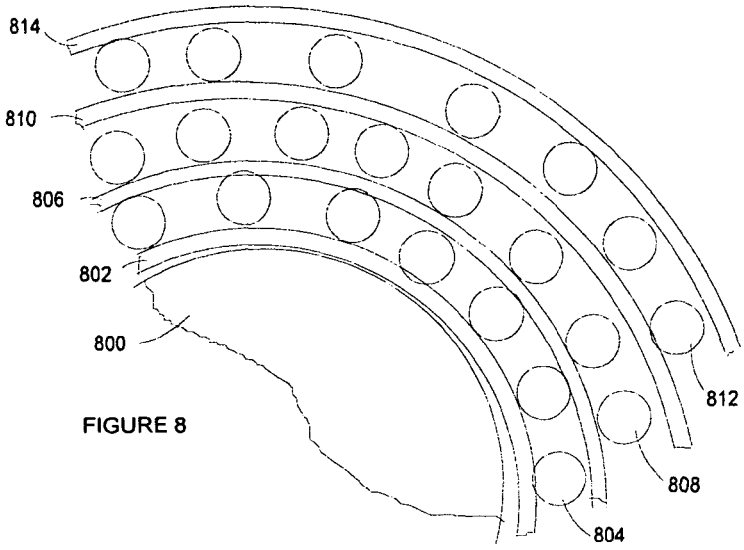
FIG. 8 is a cutaway to view of a fiber having multiple layers of cling agents and active agents with the cling agents having different dissolving times.

In an alternate embodiment, the substrate 800 of FIG. 8 can be coated with a first cling agent 802 having a first dissolving time period, after which the active ingredient 804 is applied. The active ingredient 804 is then coated with a second cling agent 806 which has a second dissolving time period. The second cling agent 806 is then coated with additional layer of the same or a different active ingredient 808. The process is repeated with the third cling agent 810 having a third dissolving time period and coated with either one of the foregoing active ingredients 804 and/or 808 and then coated with a final cling agent 814. In this embodiment the final cling agent 814 has the fastest dissolving time with the first cling agent 802 having the slowest. The dissolving time of each of the cling agents 802, 806, 810 and 814 are dependent upon their final use and can be structured in any manner to achieve the desired result. For example, the final cling agent 814 and the third cling agent 810 can both be an agent, such as polyvinylpyrolidone, that dissolves almost immediately upon contact with a liquid. The second cling layer 806 can have a greater dissolving time than the third cling agent 810 but a shorter dissolving time than the first cling agent 802.

The substrate can alternatively be lined with precise preloaded quantity of one ingredient on the right side and another, normally incompatible, active ingredient on the left, which stored dry are stable. When used they merge when wet and perform the intended function on the targeted surface, solution, environment, etc. Normally a two part system or solution would have to be used and stored separately increasing costs.

Using the indirect method to coat and treat substrates is ideal for applying oils, large polymers, soaps, oxidizers, harsh acids or alkali's or other seemingly impossible coating attributes. The coating procedure is performed by first treating an inert or absorbent secondary carrier 500, as illustrated in FIG. 5, such as talc, paper, carbon, charcoal, or any microporous structure or specific inert or semi-inert carrier designed for the intended application. For example, an oil based fragrance 506 is first adsorbed and dried onto talc 500 or activated charcoal. The treated talc 500 is then easily applied to the substrate as described heretofore, and illustrated in FIG. 6. The cling agent is applied to the fiber 604 causing the talc 500, or other secondary carrier, to adhere to the fiber 604. When using undiluted oils, the oily ingredient is first thinned out using an appropriate solvent, alcohol, etc. then directly applied to the secondary carrier.

In some instances, such as when using high molecular weight polymers, oils, organics, etc., and secondary carrier is too oily, not a dry enough particle or incompatible with the cling agent a tertiary carrier can be used. This would be an alternate to the use of micro-encapsulation that can be used to render any problematic active, acidic, basic, gaseous or oxidizing particles into a form that can be readily coated on a substrate material.

If the device is a cat litter pad cartridge, the middle to top of a specifically designed substrate of an air laid high loft non-woven is treated with a cling agent and filled with a specific choice of cat litter. The desired cat littler can be clumping, wheat, crystal, clay, or any brand of cat litter that is resistant to sticking to the cat's claws when used. Preferably the bottom region of the pad is initially treated with a super-absorbent polymer in the form of a powder, sheet, web, or pellet so as to generate super absorbency in combination with the upper litter filled substrate. The very bottom layer of the pad is a waterproof sheet applied before or after the application of ingredients to the fibers. The same pads can be used for puppy training pads, or housebreaking pads, with the exception that litter is not needed. Rather than using a high or low loft nonwoven, a flatter absorbent carded, or garneted cross lapped nonwoven can be used.

Packaging, similar to that described in conjunction with FIG. 1 would be used for the cat litter device so as to make shipping and final use easier than the old fashioned way of buying large bags, storing them, opening, pouring with dust creation, cleaning, washing, etc. Lightweight litter inserts are simply placed in the litter box, free of dust, subject to the absorption cat urine in the super absorbent and/or plain litter. The litter inserts are used in combination with water impervious plastic backing. It can prevent odors for a week or two, and then simply be discarded.

Figure 7:
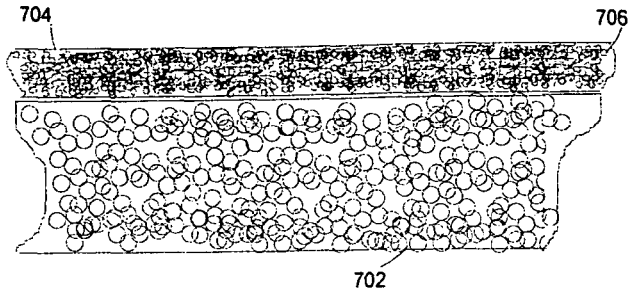
FIG. 7 is a side view of a sponge manufactured in accordance with the instant invention.

In another embodiment, a sponge 702 as illustrated in FIG. 7 in combination with a nonwoven substrate 704, such as the drylaid High loft PB63BDA by Ahlstrom, can be extremely useful for scouring, disinfecting, cleaning, etc with one side then used for mopping and absorbing up the excess liquid with the other. Although in most applications the highloft nonwoven would be the preferred substrate, in some applications the carded, cross lapped, needlepunched, melt blown, etc., nonwovens may be more applicable. The scouring cleanser, disinfectant 706 can then be applied to the substrate via any of the cling agent methods described in this application. Scouring cleanser is typically calcium carbonate and is found in products sold under trademarks such as Ajax, Comet, and Bon Ami. The calcium carbonate is distributed within a non-woven substrate and preferably bonded to the fibers of the non-woven substrate by a soft, tacky, non-reactive adhesive. The substrate and the distribution of calcium carbonate within the carrier provide a product that is unlike a polishing wheel. Water releases some of the calcium carbonate from the non-woven substrate and some stays in the substrate. The combination of a tough high loft substrate, scouring powder, bleach, and/or a disinfectant works together to provide a superior result as compared to prior art products.

The resultant home cleaning or personal product is far superior to any sponges on the market that have an abrasive only attached to the sponge, but no active ingredients for scouring, disinfecting, etc. This differs from prior art sponges in that the active ingredient producing the desired affect can be already incorporated within the substrate. Any denier nonwoven can be applied to the back of a spongy, absorbent material, such as a paper blotter, synthetic sponge, etc., treated with cling agent, and active ingredient to produce a multi task product. This would produce a product, such as a thin hand held wipe, wand brush, or a floor mop, where one side is used to scour and disinfect and the other to mop up and soak up liquids.

In another embodiment for personal cleaning, body wash complete scrub wipes can be gentle soaps and conditioner formulations applied to a soft but durable nonwoven. Use once and dispose of. Active ingredients release when applied to wet skin. Helps to remove, dead, dry skin, while also cleaning, applying pleasant fragrances and skin conditioners.

Bubble bath bathing salts pads area decorative nonwoven shaped one layered or more pad that is dropped into the bath releasing a mixture of minerals and bubble bath. The nonwoven can then be used to scrub a tub after the bath water is discharged.

Scrub, Clean, and Sanitize scrubwipes are skin cleaning formulations applied to a soft but durable high loft nonwoven. Use once and dispose of. Scrubs, Cleans and Sanitizes all in one wash. Flexible nonwoven fibers get into the areas of skin and fingernails similar to a brush that ordinary washcloths cannot do. Ideal for Home, Medical, Industry.

Laundry conditioners, detergents, softeners, whiteners, etc. can now be handled using lightweight, dustless, premeasured, materials. Many different approaches using this technology can be derived for the Laundry Segment of the marketplace.

In another embodiment a disposable, absorbent, soap dish, of highloft nonwoven construction, impregnated with super absorbent polymer on fibers, supports the bar of soap in the air. The soap bar remains dry, and fresh. No soap scum forms at the interface of the soap bar and bottom on an ordinary type of soap dish. This modern insert or free standing soap dish helps to eliminate routine cleaning of soap dishes or holders. The "WEB" supporting the bar can also catch and hold any soap scum, suds, drippings, or dirt from the bar as well as emit a fragrance of its own. It can be used to scrub the bar clean and free of soil adhering to the bar. Used alone or as an insert for existing soap dishes, or built in tub or sink structures the insert is disposed of after it appears soiled. The water impervious backing can be any type of material or embossed design to enhance the appearance.

The entire realm of Particle Pad Products represents a line of unique disposables, capable of providing a variety of modern consumer benefits in and out of the home. Representative products include Dry Scour-Scrub Disinfection wipes for sinks, tubs, tiles, etc. These dry wipes contain scouring agent, disinfectant, all in one tough nonwoven scrub pad with latex backing for ease of handling. Dry and ready to use, the wipe rehydrates upon touching a wet surface, releasing active ingredients as it is scrubbed onto a surface. The entire pad is disposed of after use. The need for purchasing, storing, handling, old fashioned heavy cans of scouring cleansers is eliminated. The need to pour dusty, active ingredient which can enter eyes, lungs, track elsewhere is eliminated. A secondary cloth, or sponge needed for scrubbing is no longer necessary and the nonwoven is more ideal for scrubbing.

A variety of line extensions can be materialized to fulfill future consumer demand. Some examples are: Dry Scour Scrub Cleaning Disinfection Toilet Brush. Using the same structure as above but designed to be used with a brush handle, this brush has the same advantages as the above product.

Dry Cleaning Disinfection Mop Heads—Wide mop head for use with mop handle on kitchen, bathroom and tile floors. A variety of line extensions regarding, cleaners, polishes, fragrances, etc. can be materialized to fulfill consumer demand Dish Rack Drain Pads—Designed to replace or insert within the standard two dimensional Rubbermaid trays under dish racks. These racks constantly fowl with discoloration, scum, liquid, and debris requiring constant cleaning. These antibacterial pads trap moisture, debris, and prevent scum and odor formation. After noticeable use the pads are easily disposed of and replaced. Cleaning of the tray is not required, and there is no need to purchase old fashioned trays.

Garbage Pail Disinfection Deodorizer Absorbent Pads—Circular or other shaped pads that entrap, absorb, disinfect, and deodorize all of the materials that soil the bottom of a waste or garbage pail. Design and functions are the same as the dish rack pad.

Refrigerator Compartment Pads—A basic two layered pad can fit in the vegetable, meat, or other refrigerator compartments. The absorbent pad and its fibers entrap leaves, liquids, juices, etc. that accumulate over time and soil the compartment. Pads are disposed of periodically. A three layered pad could also house disinfectants and deodorizers, such as baking soda, providing multiple novel advantages to consumers.

Pots and Pans Cleaner Scrubber—Lightweight, modern, durable nonwoven pads can contain cleanser in the pores between fibers. The pad starts to work as soon as it hits the wet surface. Advantages include freedom from scratching and rusting.

In another embodiment, silica gel is used as an active ingredient for absorbing moisture. Since the moisture will penetrate the non-woven pad, distribution of the silica gel through the pad, is highly effective and maximizes the surface area of the silica gel that can be exposed to the moisture laden environment. Dyes can indicate when the gel is saturated with moisture and used up.

The compositions of the present invention may be added to medical devices comprising ionic and/or polar hydrophilic polymers. Such combinations create medical devices that are effectively antimicrobial in nature, and very desirable from a practical standpoint. Preferably, hydrophilic polymers suitable for the present invention are selected from synthetic hydrophilic polymers and derivatives of animal or vegetable hydrophilic polymers. In one embodiment, a hydrophilic polymer is selected from compounds such as, but not limited to, polysaccharides (i.e., for example, cellulose derivatives such as, but not limited to, sodium carboxymethylcellulose and hydroxyethylcellulose), alginates (i.e., for example, sodium alginate), collagen (i.e., for example, porcine collagen), etc. Other preferred polymers include, but are not limited to, polylactic acid, polyhydroxybutyrates or similar polyesters, polyvinyl alcohol, polyvinylpropylene, polyacrylates, hydrophilic polyurethanes, polymaleic acid and polymers of natural origin like glucosaminoglycans, collagen and fibrin or the like, as well as copolymers or derivatives thereof. The hydrophilic polymers listed above may be crosslinked, partially crosslinked or non-crosslinked.

The disclosed technology enables the substrate on a sponge to be impregnated with a chlorinated product for use as a bleach or disinfectant, such as chlorinated isocyanurates or sodium dichloro-s-trazinetrione and its dehydrate, as well as other chemicals which hydrolyze in water to release chlorine as hypochlorous acid. Trichloro-s-triazinetrione, CAS Registry Number: 000087-90-1, can also be used in the disclosed invention as chlorinators where a stronger release of chlorine is required, as for example, as an algaecide.

Another example of an extremely difficult material to apply directly to nonwoven substrates is an oil based or very reactive compound such as a chlorine ingredient. This can now be accomplished by soaking or spraying the oil or oxidizing compound on a compatible, non-reactive absorbent or microporous structure such as talc, charcoal, zeolite, etc., and then drying talc, paper, or other inert absorbent particles with the oil based or reactive chlorine ingredient. The compound/carrier combination is then adhered to the substrate.

The table below illustrates examples of the uses of the disclosed method in combination with some possible active ingredients. Other combinations that are not necessarily listed below but can be adhered to a substrate are quaternary ammonium compounds used in antiseptics, solvents, emulsifying agents and surfactants and drugs. It should be noted that other synthetic and natural chemicals and biochemicals can be used as will be known by those skilled in the art.

| NON WOVEN PRODUCT | ACTIVE INGREDIENT |
|---|---|
| Household and Pet products | |
| Litter Anti-Scatter Pad outside litter box | deodorizer |
| Food/Dish Absorbent Anti Scatter Pad | super absorbents (SAP) |
| Furniture Protection/Carrier/ Bedding Pads | deodorizer, anti-flea & tick medication |
| Disposable Grooming, Cleaning Brush/Wipe for Animals | deodorizers, medication |
| Litterbox deodorizer hang-up | deodorizers, fragrances |
| Flea & Tick Collars | Deodorizers, anti-flea & tick, medication |
| Litter cartridges | various cat litter, super absorbents, deodorizers |
| Puppy Training Pads and Litterbox pads | Superabsorbent disinfectant, deodorizer |
| Pet cages, beds and carriers | Superabsorbent, disinfectant, deodorizer |
| Scrubwipe | detergent, disinfectant, scouring powder |
| Cleaning brushes, mops, brillo type pads | Deodorizer, Disinfectants, SAP |
| Doorway Mats, and Runners | Super absorbent, baking soda, anti-microbial |
| Bathroom, bedroom mats and runners | Super absorbent, baking soda, deodorizers antibacterial |
| Children's Dinner/highchair mats | Super absorbent |
| Dish rack, drain pads, kitchen and bathroom counter pads | Super absorbent deodorant, odor adsorbing agent, bactericide, |
| Drain Pad for Soiled Shoes | Super absorbent, disinfectant, deodorizer |
| Shoe insert | Super absorbent, deodorizer, disinfectant |
| Soap dish Pads | Super absorbent, deodorant, bactericide |
| Flowerpot Pads | Super absorbent, deodorant, bactericide, insecticide |
| Pots and Pans scrub/wipe | Cleaner, detergent |
| Refrigerator Pads, Boxes, or Hang-ups | Charcoal, Silica, Baking Soda, Odor Counteractants |
| Wipes, Brushes, Mops, Brooms | Disinfectants, Deodorizers, Detergents, oxygen compounds |
| Car mats | Super absorbent, Oleophilic/lipophilic agent |
| Garbage, waste pail pads | Super absorbent, deodorant, odor adsorbing agent, bactericide |
| Baking Soda, Deodorant Pads or hang-ups | Baking Soda Particles, Deodorizers |
| Washing machine pads | Fabric softeners, detergents, bleaches, |
| Insect traps | insecticide, bait, fragrance, pheromone |
| Disposable Toothbrush | Dental powder, toothpaste, mouthwash |
| Electrostatic Nonwoven Wipes | Fibers, Antibacterials, Cleaning, Scouring |
| Baking Soda Refrigerator Pads | baking soda and/or other deodorizing agent |
| Air Freshener Filter Devices | Deodorizers, Fragrances |
| Louffa, shower pads | Bath soaps/oils, fragrances, skin conditioners |
| Weed prevention mats | herbicides |
| Clothing lint, fur, soil, brushwipes | Open, sticky, tackifier |
| Laundry Pads | Detergents, softeners, chlorine compounds |
| Dishwasher pads | Detergents, softeners, chlorine compounds |
| Toilet tank or bowl pads | |

Commercial, Diagnostic & Medical:

Some additional commercial and home uses include a dust collecting pad for use in heavy cleaning areas, such as all types of workshops and clean rooms. In this embodiment charged negative and positive particles, such as beads, would be placed in the substrate in alternating rows to enhance electrostatic cling. The collector pads can be used for industrial, medical, dental, office, school, dusts, debris, medical waste, and general wastes such as metal shavings, copy machine cartridge, wood dust, etc. Baking soda and/or other deodorizing agent, bactericide, medications, antibiotics, medicated powders, anti-fungals, etc. High lofts and flatter materials can be coated and used to carry active ingredient. The adhesive or cling agent can be the naturally anti-bacterial Povidone which is polyvinyl pyrolidone and iodine. Some examples are:

| Medical and Dental with Active | Ingredients |
|---|---|
| Surgical Dressings | medicated powders, medications, antibiotics, oxygen, air, SAP |
| Casts, splints | Anti-itch powders, antibacterial-fungal, oxygen, air, SAP |
| Aerator Bed pads | deodorizers, bactericides-fungal, medications, SAP |
| Surgical trays | super absorbent, antibacterial |
| Specimen trays | super absorbent, antibacterial |
| Aerator Band-Aids | superabsorbent polymer, antibacterial, oxygen. |
| Hospital food serving trays | |
| Floor, bathroom mats | super absorbent, antibacterial, deodorizers |
| Dental prep trays | super absorbents |
| Pathology inspection, dissection trays | super absorbents, antimicrobials |
| Feminine Hygiene Aerator pad | Super absorbents |
| Infant Aerator Diaper pads | super absorbents |
| Scrub wipes | Disinfectants, etc |
| Diagnostic reactions | Diagnostic and biological test reagents |
| Schools | |
| Luncheon trays | super absorbents |
| Work station pads | super absorbents |
| Dissection mats | super absorbents, antibacterials |

Military applications include explosive and primer coatings, radiation resistant filters, and clothing and can include lead and lead based radiation and radar absorbing particles.

Example I

In general it was found that the rubber or latex water based compounds were easier to work than other compounds, while yielding better coatings. Other coatings can be used, providing more application specific results. In general water based compositions are least reactive or non-reactive with the active ingredients. The cling agent may be active ingredient specific and/or application specific and determination of the best cling agent to use with individual active ingredients in specific applications will be evident to those skilled in the art. The following is an example of a successful testing process:

Arm& Hammer Brand baking soda fine powder and Comet Cleanser™ as a source of scouring agent and sodium dichlorotriazinetrione dihydrate were each dropped separately and shaken onto two separate substrates. The substrates used are 5 inch long×1 inch wide strips of a high loft non-woven supplied by Ahlstrom (PB63DA). The substrates were first treated with cling agents, properly diluted and applied by pressure sprayer.

The dilution ratios of each ingredient were determined in order to establish concentrations that resulted in the best products. For example, it was found that if the recommended concentration of the cling agent Rhoplex™, was cut in half, the best spray and resulting coating was achieved. This ratio is for this specific example and may be different for individual cling agents.

After carefully observing and recording the drying or open time, specific for each sprayed adhesive, the powder was applied. It is important to determine when the adhesive/tackifier goes from a wet liquid state to a very tacky condition thus eliminating any aqueous involvement. In this case the times ranged from 4 to 15 minutes, the water based adhesives taking a longer time than the solvent based. Heated air speeded up the drying and evolved the stickiness more quickly. This process was repeated using various cling agents as well as active ingredients.

The mean diameter of the open pores of the web material must be greater than the mean diameter of the particles, for the particles to be deposited within the pores of the web. Where the web is used to collect particles, the web preferably has some pores that are about equal in diameter to the particles in order to trap and retain the particles. Thus, the particles migrate through the large pores of web and are retained in small pores.

Where the web is used as a deodorizer of the type that is used in refrigerators, the average, or mean pore size must be substantially greater that the mean size of the particles. In this manner, air can freely flow through the web.

Where the web is used to deliver a fragrance, the mean pore size or diameter, can be extremely large compared to the mean diameter of the particles. Ratios of ten to one, one hundred to one, or greater can be used.

In each instance where the web is used as a carrier, or trap for particles, the mean diameter of the pores must be large enough to accommodate the particles that are to be carried or trapped in the web. Thus, the mean pore diameter is most advantageously at least twice the mean diameter of the particles.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart there from.

What is claimed is:

1. An open pore fibrous web having a plurality of particles of an active ingredient within the pores of the web, an adhesion enhancing agent bonded to the fibers of said fibrous web and said plurality of particles of an active ingredient, whereby said particles are bonded to said fibers by said adhesion enhancing agent, wherein said web is a nonwoven pad and said adhesion enhancing agent is substantially uniformly distributed through out said pores and wherein said nonwoven is a high loft nonwoven.

2. The open pore fibrous web of claim 1, where said active ingredient is selected from the group consisting of baking soda, antimicrobials, antibacterials, cat litter, deodorants, fragrances, soaps, salts, detergents, oxidants, surfactants, and superabsorbant polymers.

3. The open pore fibrous web of claim 2, wherein said active ingredient is an antibacterial agent.

4. The open pore fibrous web of claim 2, wherein said active ingredient is cat litter.

5. The open pore fibrous web claim 2, where said active ingredient is a superabsorbant polymer.

6. The open pore fibrous web of claim 1, where said active ingredient is an antibacterial agent.

7. The open pore fibrous web of claim 1, where said active ingredient is baking soda.

8. The open pore fibrous web of claim 1, where said active ingredient is an antibacterial agent.

9. The open pore fibrous web of claim 1, where said active ingredient is sorbed by a carrier compound.

10. The open pure fibrous web of claim 1, wherein said fibers are fused by mechanical, chemical bonded, or thermal bonding.

11. The open pore fibrous web of claim 1, where the mean diameter of the pores of said open pore fibrous web is at least twice the mean diameter of said particles.

12. The open pore fibrous web of claim 11, wherein the mean diameter of the pores of said open fibrous web is at least ten times the mean diameter of said particles.

13. The open pore fibrous web of claim 1, wherein the mean diameter of the pores of said open fibrous web is at least fifty times the mean diameter of said particles.

14. An open pore fibrous web having a plurality of particles of an active ingredient within the pores of the web, an adhesion enhancing agent bonded to the fibers of said fibrous web and said plurality of particles of an active ingredient, whereby said particles are bonded to said fibers by said adhesion enhancing agent, where said active ingredient is selected from the group consisting of baking soda, antimicrobials, antibacterials, cat litter, deodorants, fragrances, soaps, salts, detergents, oxidants, surfactants, and superabsorbant polymers and where said active ingredient is a microencapsulated active agent.

15. An open pore fibrous web having a plurality of particles of an active ingredient within the pores of the web, an adhesion enhancing agent bonded to the fibers of said fibrous web and said plurality of particles of an active ingredient, whereby said particles are bonded to said fibers by said adhesion enhancing agent, wherein said web is a nonwoven pad and said adhesion enhancing agent is substantially uniformly distributed through out said pores and further comprising an adhesion enhancing agent bonded to said fibers or filaments and a plurality of particles of an active ingredient sorb on a carrier compound, said carrier compound being bonded to filaments or fibers by said adhesion enhancing agent.

16. The open pore fibrous web of claim 15, wherein said active ingredient is selected from the group consisting of baking soda, antimicrobials, antibacterials, cat litter, deodorants, fragrances, detergents, oxidants, surfactants, and superabsorbant polymers.

17. The open pore fibrous web of claim 15, wherein said pad is bonded to an impermeable substrate member.

* * * * *